US007744485B2

(12) United States Patent
Jones et al.

(10) Patent No.: US 7,744,485 B2
(45) Date of Patent: Jun. 29, 2010

(54) GOLF PUTTER HEADS AND REMOVABLE PUTTER WEIGHTS

(75) Inventors: David D. Jones, Phoenix, AZ (US); Richard R. Sanchez, New River, AZ (US); Bradley D. Schweigert, Anthem, AZ (US); Michael R. Nicolette, Scottsdale, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 91 days.

(21) Appl. No.: 12/101,101

(22) Filed: Apr. 10, 2008

(65) Prior Publication Data

US 2009/0258725 A1 Oct. 15, 2009

(51) Int. Cl.
*A63B 53/04* (2006.01)
*A63B 53/06* (2006.01)

(52) U.S. Cl. ..... 473/324; 473/332; 473/334; 473/338; 473/340; 473/341; 473/349; 473/409

(58) Field of Classification Search ..... 473/324–350, 473/409; D21/736–746
See application file for complete search history.

(56) References Cited

U.S. PATENT DOCUMENTS

| | | | | | |
|---|---|---|---|---|---|
| 1,133,129 | A | * | 3/1915 | Govan | 473/337 |
| 2,163,091 | A | * | 6/1939 | Held | 473/338 |
| 2,954,231 | A | * | 9/1960 | MacIntyre | 473/251 |
| 3,143,349 | A | * | 8/1964 | MacIntyre | 473/338 |
| 3,419,275 | A | * | 12/1968 | Winkleman | 473/335 |
| 3,556,533 | A | * | 1/1971 | Hollis | 473/338 |
| 3,961,796 | A | * | 6/1976 | Thompson | 473/328 |
| 4,423,874 | A | * | 1/1984 | Stuff, Jr. | 473/338 |
| 4,754,977 | A | * | 7/1988 | Sahm | 473/337 |
| 5,050,879 | A | | 9/1991 | Sun | |
| 5,244,210 | A | * | 9/1993 | Au | 473/252 |
| 5,431,401 | A | * | 7/1995 | Smith | 473/251 |
| 5,439,222 | A | | 8/1995 | Kranenberg | |
| 5,489,097 | A | | 2/1996 | Simmons | |
| 5,533,730 | A | | 7/1996 | Ruvang | |
| 5,571,053 | A | * | 11/1996 | Lane | 473/336 |
| 5,769,737 | A | * | 6/1998 | Holladay et al. | 473/336 |
| 6,102,813 | A | * | 8/2000 | Dill | 473/305 |
| 6,206,790 | B1 | | 3/2001 | Kubica | |
| 6,270,422 | B1 | | 8/2001 | Fisher | |
| 6,306,048 | B1 | * | 10/2001 | McCabe et al. | 473/333 |
| 6,348,014 | B1 | | 2/2002 | Chiu | |
| 6,485,375 | B1 | | 11/2002 | McKinley | |
| 6,749,523 | B1 | | 6/2004 | Forzano | |
| 7,083,530 | B2 | * | 8/2006 | Wahl et al. | 473/334 |
| D574,050 | S | * | 7/2008 | Jones et al. | D21/759 |
| 2002/0032075 | A1 | | 3/2002 | Vatsvog | |
| 2006/0030420 | A1 | | 2/2006 | Roake | |

(Continued)

FOREIGN PATENT DOCUMENTS

| | | |
|---|---|---|
| GB | 2195546 | 4/1988 |

(Continued)

*Primary Examiner*—Sebastiano Passaniti

(57) ABSTRACT

Embodiments of golf clubs, golf club heads and removable golf club weights are generally described herein. According to certain embodiments, an example golf club head comprises a face for striking a golf ball, a backside portion, a sole portion, and one or more removable weights. According to such embodiments, the example golf club head may further comprise a vibration damping composition disposed between the removable weights and the golf club head.

19 Claims, 7 Drawing Sheets

U.S. PATENT DOCUMENTS

| | | | |
|---|---|---|---|
| 2006/0058112 | A1 | 3/2006 | Haralason |
| 2006/0178229 | A1 | 8/2006 | Liang |
| 2007/0129164 | A1 | 6/2007 | Shimazaki |
| 2008/0039229 | A1 | 2/2008 | Lo |

FOREIGN PATENT DOCUMENTS

| | | |
|---|---|---|
| JP | 2006000435 | 1/2006 |
| JP | 2006198251 | 8/2006 |

* cited by examiner

GOLF PUTTER HEADS AND REMOVABLE PUTTER WEIGHTS

TECHNICAL FIELD

The present disclosure relates generally to golf equipment, and more particularly, to golf putters heads, methods for manufacturing golf putter heads, and removable weights used in connection therewith.

BACKGROUND

The moment of inertia (MOI) generated by a golf club head is affected by the amount and distribution of weight located in the club head, including putter heads. The performance of an individual using a golf club head may be influenced by the MOI, insofar as an increase in the MOI of the golf club head may increase resistance to unwanted twisting of the golf club head during off-center hits. As a result, increasing the MOI of golf club heads may provide greater forgiveness during off-center hits. Therefore, it is generally desired to increase the MOI of a golf club head, in a manner (and to an extent) that is desired by a particular individual.

DESCRIPTION OF EXAMPLES OF EMBODIMENTS

Figure 1:
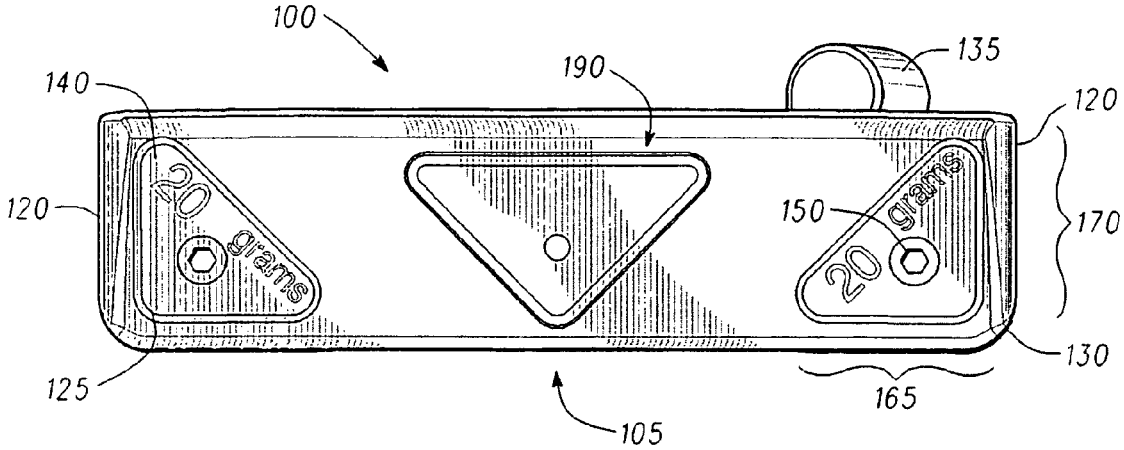
FIG. 1 is a bottom view of an example golf club head according to an embodiment of the apparatus and articles described herein.

In general, methods, apparatus, and articles of manufacture associated with golf club heads are described herein. The methods, apparatus, and articles of manufacture described herein are not limited in this regard.

In the examples of FIGS. 1-8, a golf putter head 100 may include a sole portion 105, a face portion 110 used to impact a golf ball (not shown), which is also referred to herein as the striking face, a back portion 115, and two side portions 120. The golf putter head 100 may also include a toe portion 125 and a heel portion 130. The golf putter head 100 may further include a hosel portion 135, which is adapted to receive one end of a shaft (not shown). In one example, the golf putter head 100 may be manufactured from steel material or steel-based material by a casting process, a forging process, a combination thereof, or other suitable manufacturing processes.

Figure 2:
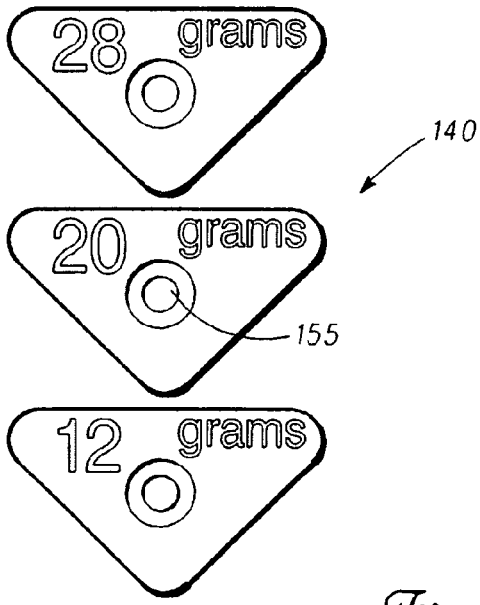
FIG. 2 depicts a front view of an example set of removable weights according to an embodiment of the articles described herein.
Figure 3:
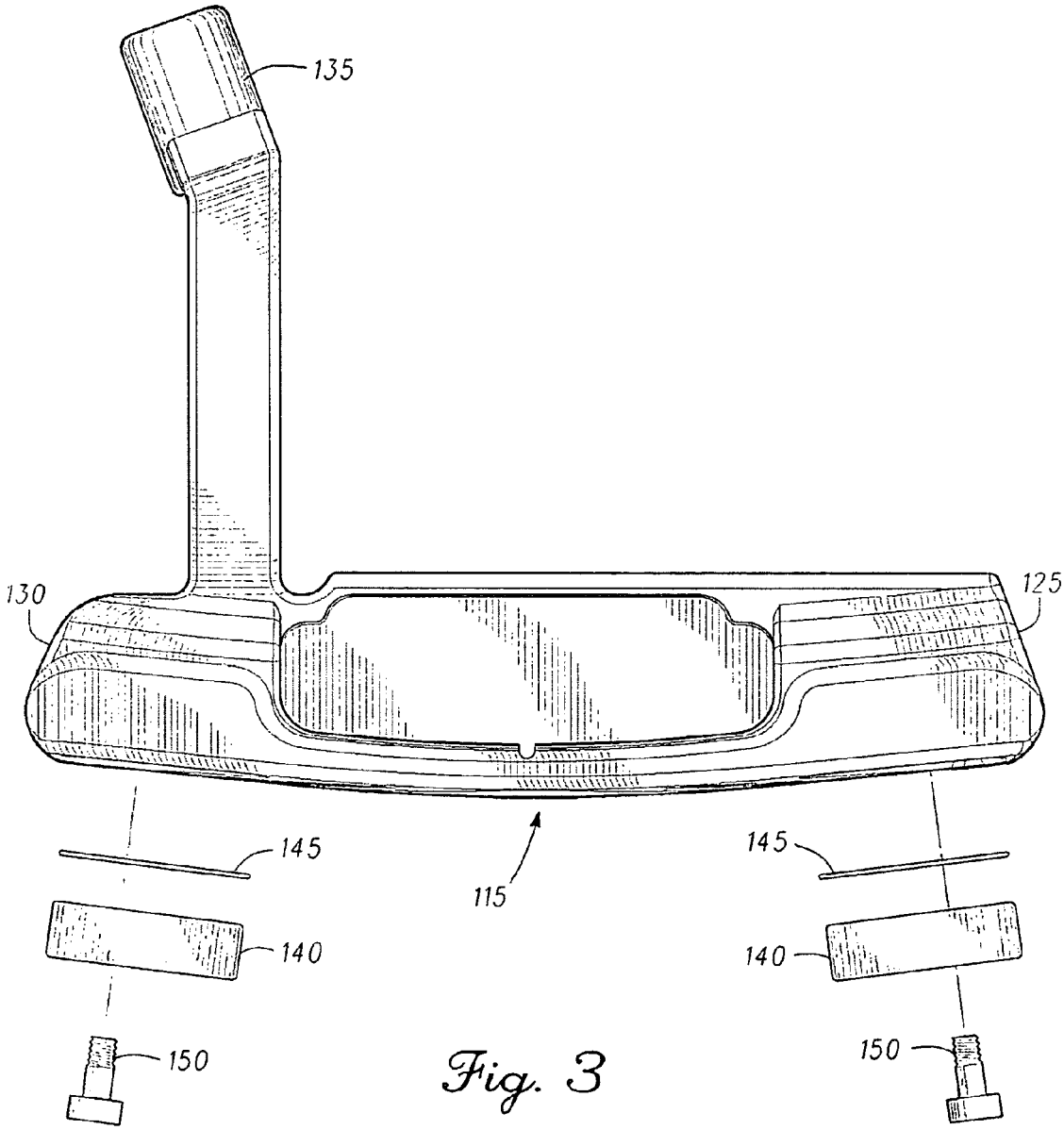
FIG. 3 depicts a back view of an example golf club head that comprises an example set of removable weights described herein.
Figure 4:
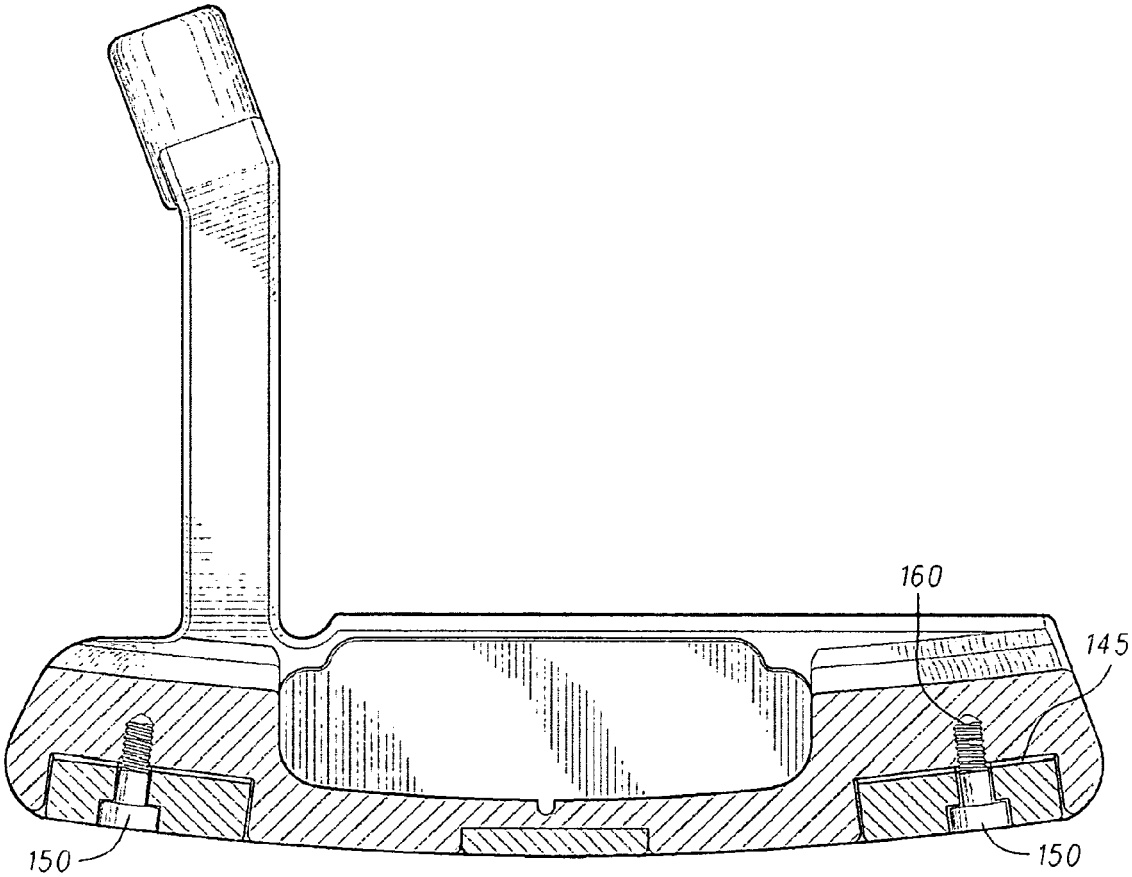
FIG. 4 depicts a back, cross-sectional view of the example golf club head of FIG. 3.

Referring to FIGS. 1 and 2, for example, the golf putter head 100 may be provided with a plurality of removable weights 140, which may be disposed within at least one cavity that houses the removable weights 140. For example, the golf putter head 100 may be provided with one or more of the plurality of removable weights 140 at the toe portion 125 and heel portion 130 thereof, each of which may, optionally, be disposed in the same or separate cavities formed within the golf putter head. By positioning one or more of the removable weights 140 at the toe portion 125 and the heel portion 130 of the golf putter head 100, the MOI of the golf putter head 100 may be increased, or otherwise altered relative to the MOI of the golf putter head 100 without the removable weights 140.

According to certain embodiments, the golf putter head 100 may further comprise a third removable weight disposed near a center portion 190 of the golf putter head 100. The third removable weight disposed near the center portion 190 of the golf putter head 100 may, optionally, be used by an individual to increase the total mass, and momentum generated by, the golf putter head 100.

Referring to FIGS. 3-6, a vibration damping composition 145 may be disposed between the removable weights 140 and the golf putter head 100. The vibration damping composition 145 may be comprised of any material capable of reducing unwanted noises and vibrations that would otherwise be caused by metal-to-metal contact (e.g., between one of the removable weights 140 and the body of the golf putter head 100), such as urethane, rubber, foam, plastics, elastomers, or combinations thereof.

Figure 5:
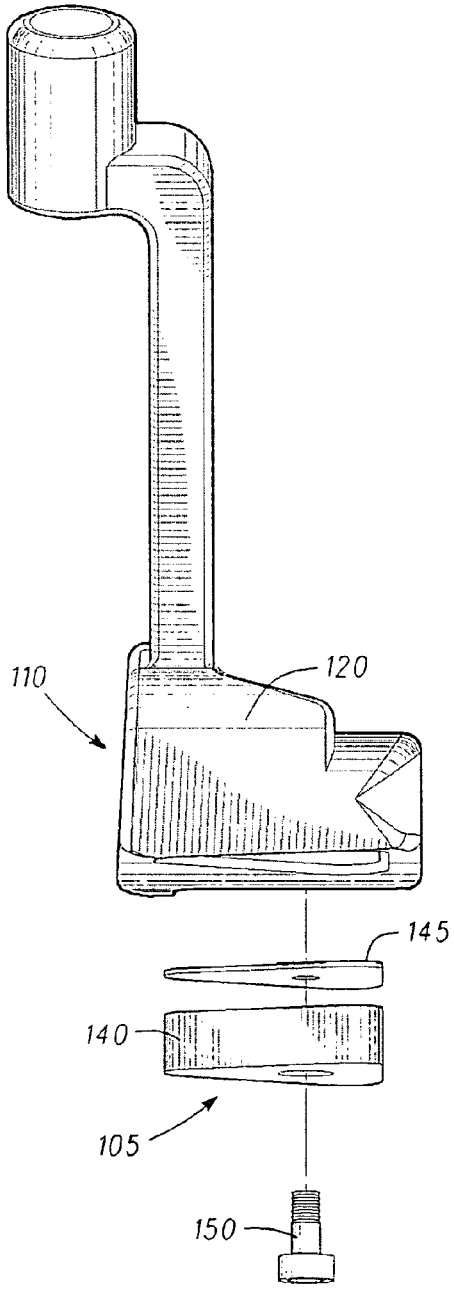
FIG. 5 depicts a side view of the example golf club head of FIG. 3.
Figure 6:
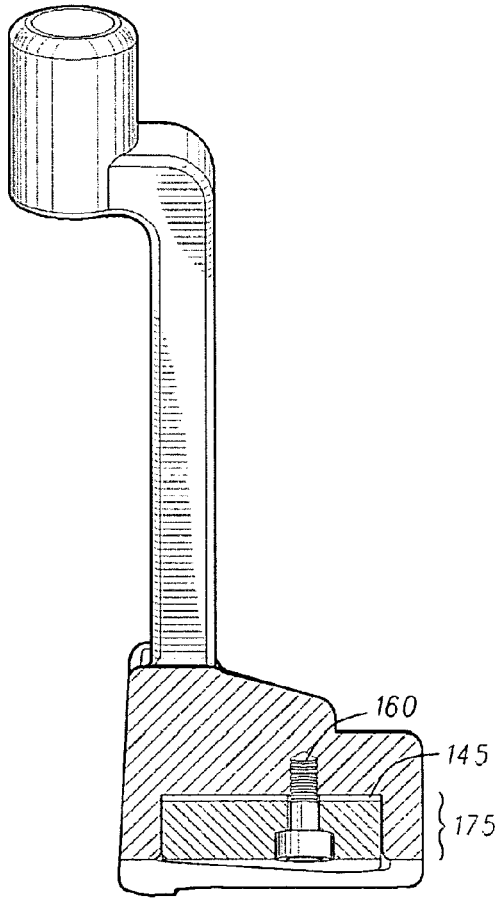
FIG. 6 depicts a side, cross-sectional view of the example golf club head of FIG. 3.

The removable weights 140 may be disposed in the sole portion 105 (as shown in FIG. 1) and/or back portion 115 of the golf putter head 100. The removable weights 140 may be reversibly secured to the golf putter head 100 using any suitable means. For example, the removable weights 140 may be disposed in the sole portion 105 (as shown in FIG. 1) by reversibly attaching the removable weights 140 to the sole portion 105 using a threaded screw 150 (FIGS. 1 and 3-6) which is disposed through a hole 155 (FIG. 2) located within the removable weights 140. According to such embodiments, the threaded screw 150 may be received by a threaded hole 160 located within the body of the golf putter head 100, such as in the sole portion 105 of the golf putter head 100. As shown in FIG. 6, for example, the golf putter head 100 may comprise one or more cavities 175, which are adapted to receive the removable weights 140 described herein, and the vibration damping composition 145 may be disposed between the removable weights 140 and the interior surface of such cavities 175.

Figure 7:
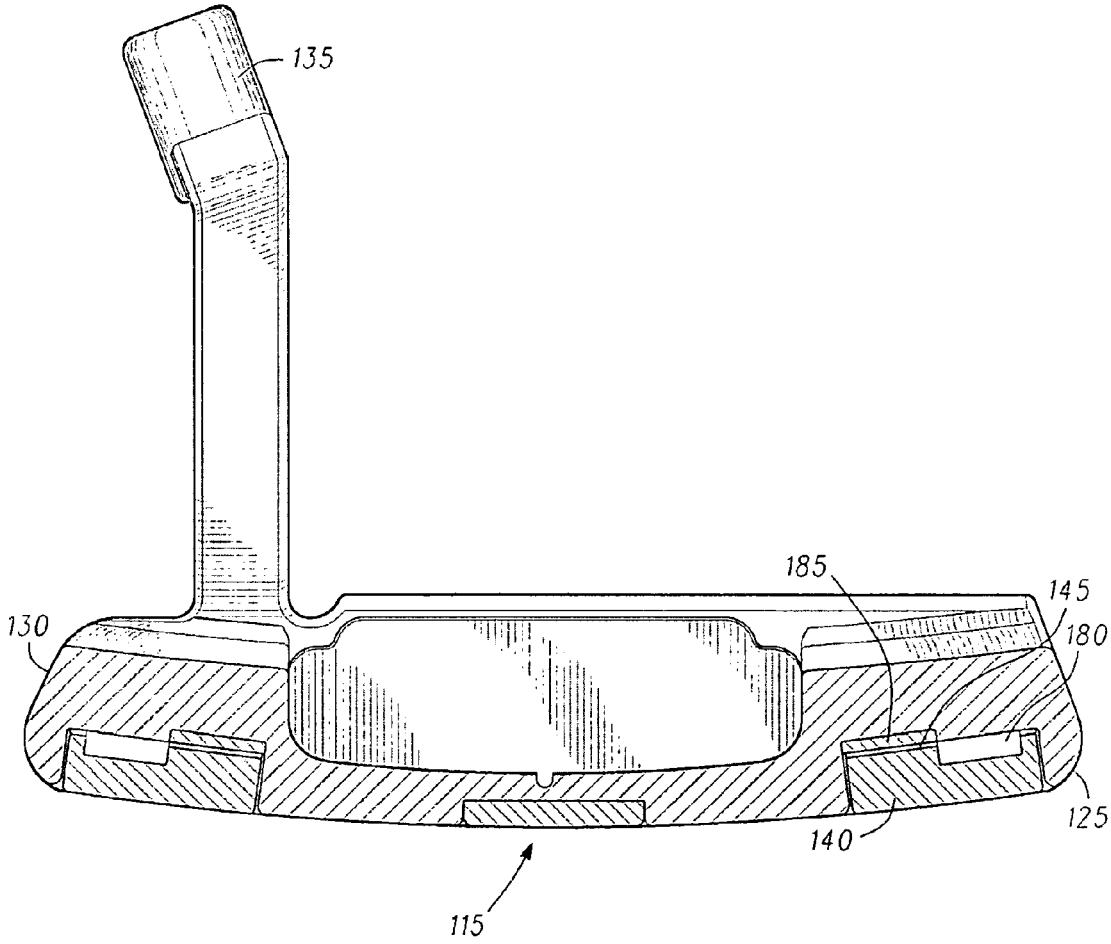
FIG. 7 is a back, cross-sectional view of an example golf club head that comprises an example set of removable magnetic weights described herein.
Figure 8:
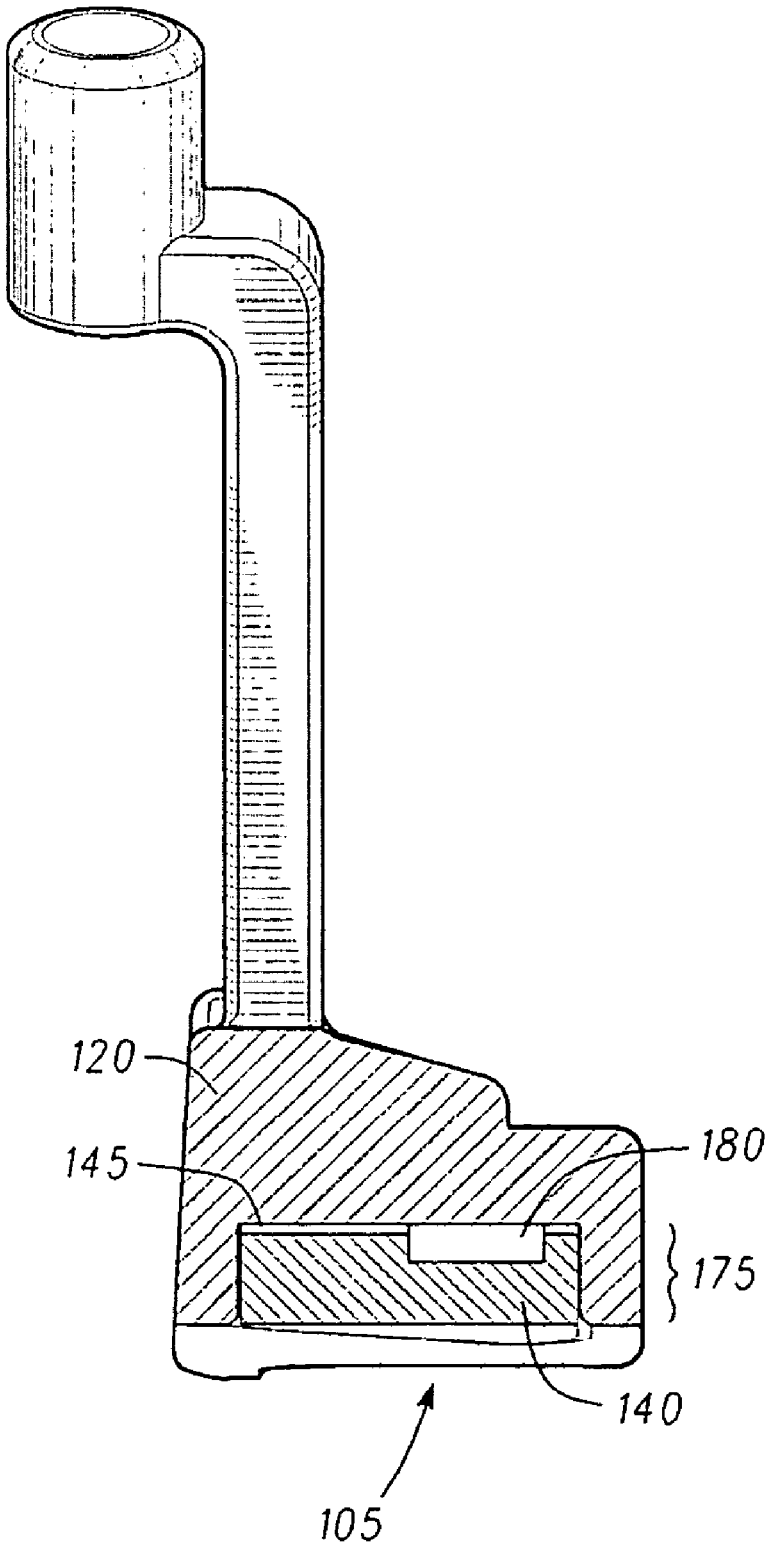
FIG. 8 depicts a side, cross-sectional view of the example golf club head of FIG. 7.

Referring to FIGS. 7 and 8, the removable weights 140 may also be secured to the golf putter head 100 through a magnetic force. For example, the removable weights 140 may be disposed within a cavity 175 formed within the golf putter head 100, such as in the sole portion 105 thereof. A magnet 180 may be attached to and disposed within the cavity 175. Similar to the other embodiments described herein, a layer of vibration damping composition 145 may be disposed between the removable weights 140 and the interior surface of the cavity 175. The golf putter head 100 may further comprise an open pocket 185, which may be used to lift the removable weights 140 from the cavity 175 and break the magnetic force holding the removable weights 140 therein. According to such embodiments, the removable weights 140 may be at least partially, or completely, comprised of a material that will be magnetically attracted to the magnet 180.

The removable weights 140 may exhibit any suitable shape and configuration, such as square, oval, elliptical, circular, rectangular, or other configurations. In the case of a circular removable weight 140, the sides thereof may be threaded, such that the circular removable weight 140 may be disposed and screwed into at least one cavity formed within the golf putter head which exhibits corresponding threads. When using removable weights 140 of other shapes, such as square, oval, elliptical, rectangular, or other configurations, the removable weights 140 may comprise, for example, a separate circular threaded protrusion on the bottom side thereof, which may be screwed into a corresponding cavity formed within the golf putter head. Alternatively, as shown in FIGS. 5 and 6, the removable weights 140 may be reversibly attached to the golf putter head using a separate threaded screw 150.

Referring to FIG. 2, according to certain embodiments, the removable weights 140 may exhibit a triangular configuration, such as a configuration that resembles a right triangle. Referring to FIG. 1, according to these embodiments, when the triangular removable weights 140 are disposed in, for example, the sole portion 105 of the golf putter head 100, the legs of the triangular removable weights 140 may be approximately parallel with the backside wall 165 and side wall 170 of the golf putter head 100, with its hypotenuse facing the face portion 110 of the golf putter head 100. According to such embodiments, a significant portion of the weight provided by the removable weights 140 is positioned towards the back portion 105 and side portions 120, which may serve to increase the MOI of the golf putter head 100.

Figure 10:
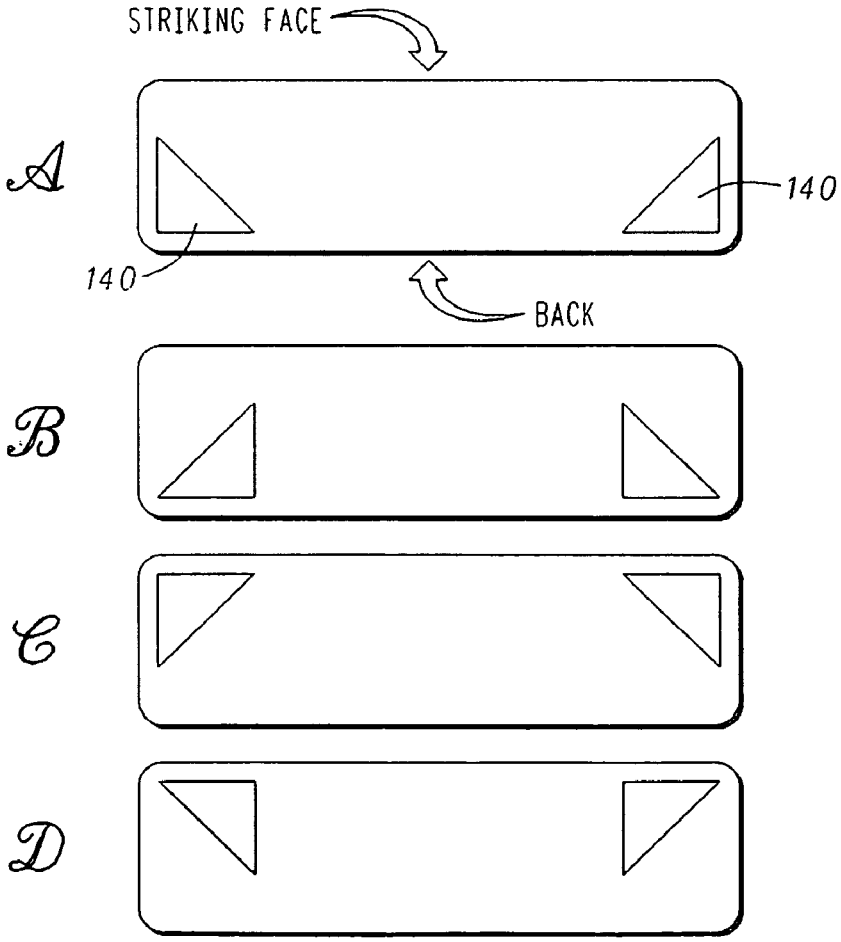
FIG. 10 is a diagram showing the removable weights described herein, disposed in the sole portion of a golf putter head in different orientations and locations thereof.

In other words, referring to FIG. 10, the removable weights 140, which may exhibit the shape of a right triangle (i.e., a triangle having a portion that comprises an angle of approximately 90-degrees), are positioned at the back and side portion of the golf putter head, as shown in FIG. 10(A). In other words, the removable weights 140 having a triangular shape may have a portion that comprises an angle of approximately 90-degrees, which is disposed in a side portion 120 of the sole and away from the striking face of the club head, as shown in FIG. 10(A). This orientation positions more of the weight of the removable weights 140 towards the back portion 105 (and side portions 120) of the golf putter head, which serves to provide the golf putter head with a greater MOI, compared to a golf putter head comprising the removable weights 140 disposed in other orientations, such as those shown in FIG. 10(B)-(D).

The plurality of removable weights 140 may selected from a group of removable weights 140, such as 2, 3, 4, 5, 6, 7, 8, or more removable weights 140. In addition, the plurality of removable weights 140 may selected from multiple pairs of removable weights 140, such as 2, 3, 4, or more pairs of removable weights 140. The removable weights 140 may be manufactured to exhibit different specific gravities, such that an individual may select the removable weights 140 that exhibit the desired specific gravity to be installed into the golf putter head 100.

The plurality of removable weights 140 may exhibit approximately the same volume. In addition, the plurality of removable weights 140 may exhibit approximately the same volume and geometric configuration. More particularly, according to such embodiments, each of the removable weights 140 may exhibit a unique specific gravity, while exhibiting approximately the same volume and geometric configuration. The removable weights 140 may exhibit different specific gravities, while retaining approximately the same volume and geometric configuration, by using different materials or combinations thereof to manufacture the removable weights 140.

Any of various methods and compositions may be employed to impart a different specific gravity to each of the removable weights 140, or pair of removable weights 140, which may be used in connection with the golf putter heads 100 described herein. For example, the removable weights 140 may be manufactured using varying amounts of a tungsten powder in connection with a suitable material, such as other types of metals, polymers, plastics, elastomers, or combinations thereof. According to such embodiments, since the plurality of removable weights 140 described herein may be designed to exhibit approximately the same volume, the amount of tungsten powder used to manufacture a particular removable weight 140 may be increased to increase the specific gravity of such removable weight 140. Conversely, the amount of tungsten powder used to manufacture a particular removable weight 140 may be decreased to decrease the specific gravity of such removable weight 140. This way, a plurality of removable weights 140 may be manufactured using varying amounts of a tungsten powder, in order to produce a group of removable weights 140 that span a range of specific gravities.

In addition to the golf putter heads described herein, further embodiments include golf putters. More particularly, golf putters are provided which comprise a golf putter head described herein, which is provided with a golf club shaft and a grip. To form a golf putter with the golf putter head 100, the hosel 135 thereof may receive a first end of a shaft (not shown). The shaft and the hosel 135 may be secured to each other by an adhesive bonding process (e.g., epoxy) and/or other suitable bonding processes (e.g., mechanical bonding, soldering, welding, and/or brazing). To complete the golf putter, a grip (not shown) may receive a second end of the shaft. The shaft and the grip may be secured to each other by an adhesive bonding process and/or other suitable bonding processes. The methods, apparatus, and articles of manufacture are not limited in this regard. By manufacturing the golf putter head 100 described herein using a casting process, it may be easier to vary the shape and size of the golf putter head 100 and create the cavities 175 for receiving the removable weights 140 described herein.

According to additional embodiments, sets of removable weights for use with the golf putter heads described herein are provided. The sets comprise a plurality of removable weights adapted to be reversibly attached to a golf putter head. As described herein, the set may comprise at least two weights that exhibit a different specific gravity. More particularly, in certain embodiments, the set of removable weights may contain 1, 2, 3, 4, 5, or more pairs of removable weights, with each pair having a different specific gravity. According to such embodiments, an individual may select the desired pair, or combination of removable weights, based on the specific gravity of such weights for application to his or her golf putter head. The sets of removable weights may allow an individual to add a desired amount of weight to the heel, toe, and/or middle portion of a golf putter head, in order to affect the total weight of the putter, its MOI, its distribution of weight, or combinations thereof.

As in the other embodiments described herein, the weights contained within any given set of weights may exhibit approximately the same volume, such that the weights look the same and will fit into a similarly-dimensioned cavity on the golf putter head, while still exhibiting a different specific gravity from other removable weights. In addition, the set of removable weights may comprise certain vibration damping compositions, which are adapted to be placed between a removable weight and a golf putter head. Non-limiting examples of such vibration damping compositions include urethane, rubber, foam, plastics, elastomers, and combinations thereof. The vibration damping compositions may be configured as, for example, a layer of vibration damping material that an individual may insert into a cavity within a golf putter head, such that a removable weight may then be disposed in the cavity such that the layer of vibration damping material resides between the body of the golf putter head and the removable weight. More specifically, for example, referring to FIGS. 3 and 6, the vibration damping composition 145 may be configured as a washer, which contains a hole in the center portion thereof (not shown), through which a threaded screw 150 may be inserted to secure the removable weights 140 and vibration damping composition 145 to a cavity 175 located within the golf putter head 100. Still further, the vibration damping composition 145 may be securely attached to the surface of the removable weights that would otherwise contact a surface of the golf putter head when disposed therein. The vibration damping composition 145 may be securely attached to the surface of the removable weights using, for example, adhesives or other chemical or mechanical bonding methods.

As described above relative to other embodiments, the removable weights contained within a set of weights may exhibit any size, shape, or configuration that is suitable for reversible attachment to a golf putter head. In certain embodiments, the removable weights exhibit a triangular configuration, and are adapted to be reversibly attached to the sole portion 105 of a golf putter head. The removable weights that are contained within a set of weights may be adapted to be secured to a golf putter head with, for example, a threaded screw, a Velcro® material, or other mechanical engagement means, provided that the golf putter head comprises a threaded hole, cavity, recess, and/or other means or dimensions that are capable of securely receiving the removable weight. In still further embodiments, removable weights that are contained within a set of weights may be adapted to be secured to a golf putter head through a magnetic force. For example, the removable weights of the golf putter head may comprise a magnet. In addition, either the removable weights or the golf putter head (whichever component does not comprise the magnet) would at least partially comprise a material that would be attracted to the magnet, such as 17-4 stainless steel. For example, the golf putter head may be provided with the magnet, with the removable weights being comprised, at least partially, of 17-4 stainless steel.

The removable weights may be manufactured using any of a variety of materials and combinations thereof to create a set of weights exhibiting a range of specific gravities, while maintaining the volume of the removable weights approximately constant. For example, a first pair of weights may be constructed with stainless steel with a specific gravity of approximately 7.7. A second pair of weights may be constructed with a combination of tungsten powder and stainless steel, with a final specific gravity of approximately 12.4. A third pair of weights may be constructed with a combination of tungsten powder and stainless steel, such that each weight of the third pair comprises more tungsten powder than a weight of the second pair, and providing a final specific gravity of approximately 17. The removable weights may be constructed of any material, or combination of materials, which allow the resulting specific gravity to be desirably adjusted. Non-limiting examples of other materials include brass, injection molded urethane parts comprising specified amounts of tungsten powder, and similar compositions.

According to such embodiments, an individual may select the desired pair of weights for application to a golf putter head. In addition, if an individual desires to have more or less weight applied to the toe portion 125 compared to the heel portion 130 of the golf putter head 100, the individual may select and apply removable weights, which originate from different pairs of weights, to the golf putter head.

According to these embodiments, the set of removable weights may be offered for sale to consumers along with a golf putter head, or may also be offered for sale to consumers apart from a golf putter head. Still further, the pairs of different removable weights contained in a set of removable weights may be selected by a consumer, such as through a website in which a consumer may identify 1, 2, 3, 4, or more pairs of removable weights (or single removable weights), which he or she desires to purchase for use with a particular golf putter head. The sets of removable weights may further comprise an attachment means used to reversibly secure the removable weights to a golf putter head, such as a wrench that is appropriately configured to facilitate the attachment and tightening of, for example, a threaded screw 150 to a golf putter head 100, in order to attach a removable weight thereto.

According to yet further embodiments methods for manufacturing golf putter heads are provided. According to these embodiments, a golf putter head is formed using, for example, metal casting methods, forging methods, or a combination thereof. The golf putter head is formed to include an area that is adapted to receive the removable weights 140 described herein, and may comprise one or more separate areas located on the backside or sole of the golf putter head, such as one or more cavities 175 located in the sole portion thereof. More specifically, the separate areas could be located on the heel portion, the middle portion, the toe portion, or a portion between the heel, middle, or toe portion of the golf putter head, and may either be located on the sole and/or backside of the golf putter head. As shown in FIGS. 1, 5 and 6, for example, the golf putter head may comprise an area located within each side portion 120 of the golf putter heads 100, such as the cavities 175, for receiving the removable weight member 140 and screw 150.

Next, one or more removable weight members 140 are installed into the golf putter heads. The installation process may employ the use of a screw (such as the screw 150 shown FIG. 5), magnetic forces (FIGS. 7 and 8), or other methods. The removable weight members 140 that are installed into the golf putter heads in accordance with these methods may be selected from a set of removable weight members 140, which includes a plurality of different removable weight members 140 having different specific gravities. Similar to the other embodiments described herein, each removable weight member 140 included within the set of removable weight members may exhibit substantially the same volume. Accordingly, the appropriate removable weight members 140 may be selected from the set of removable weight members and installed into the golf putter head.

The methods of manufacturing golf club heads may further comprise attaching a shaft to the hosel 135. The shaft and the hosel 135 may be secured to each other by an adhesive bonding process (e.g., epoxy) and/or other suitable bonding processes (e.g., mechanical bonding, soldering, welding, and/or brazing). To complete the golf club, a grip (not shown) may receive a second end of the shaft. The shaft and the grip may be secured to each other by an adhesive bonding process and/or other suitable bonding processes. The methods, apparatus, and articles of manufacture are not limited in this regard.

Figure 9:
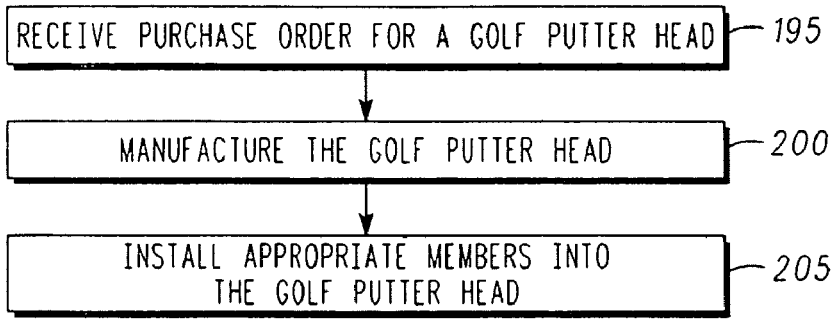
FIG. 9 is a flow diagram that outlines a non-limiting example of the methods for manufacturing a golf putter head described herein.

Referring to FIG. 9, in certain additional embodiments, the methods for manufacturing golf putter heads further comprise receiving a purchase order from a buyer 195, which identifies an amount of weight that the buyer desires to be added to the golf putter head—and the desired locations in which such weight should be added. The purchase order may be submitted, directly or indirectly, to a golf putter manufacturer using an on-line form, facsimile, conventional mail, telephone, or other communication means. Next, the golf putter head is manufactured 200. It should be appreciated that the golf putter head may be manufactured before or after receiving the purchase order from the buyer 195. The golf putter head may comprise an area that is adapted to receive an additional weight member, such as the cavities 175 located in the side portions 120 of the golf putter heads 100 described herein. Next, one or more weight members are installed in the designated areas 205 of the golf putter head. The one or more weight members may exhibit a weight that is approximately the same as the amount of weight that the buyer desires to be added to the golf putter head, in accordance with the purchase order received 195.

While FIGS. 1 and 3-8 may depict an Anser® golf putter head (PING, Inc., Phoenix, Ariz.), the methods, apparatus, and articles of manufacture described herein may be readily applicable to other suitable types of golf putter heads. For example, the methods, apparatus, and articles of manufacture described herein may be applicable to mallet putters, blade putters, and other types of putters. The methods, apparatus, and articles of manufacture described herein are not limited this regard.

Although certain example methods, apparatus, and/or articles of manufacture have been described herein, the scope of coverage of this disclosure is not limited thereto. On the contrary, this disclosure covers all methods, apparatus, and/or articles of manufacture fairly falling within the scope of the appended claims either literally or under the doctrine of equivalents.

What is claimed is:

1. A club head comprising:

(a) two or more removable weights located within a sole portion of the club head, wherein each weight exhibits approximately the same volume and is disposed in a separate cavity located within the sole portion, wherein: (i) each cavity is configured to receive no more than a single removable weight; (ii) a first removable weight of the two or more removable weights is disposed in a heel portion of the club head, and a second removable weight of the two or more removable weights is disposed in a toe portion of the club head; and (iii) the first removable weight and the second removable weight each exhibit a triangular shape having a first side portion and a second side portion forming an angle of approximately 90-degrees, wherein the first side portion of the first and second removable weight is disposed proximate to a side portion of the club head and the second side portion of the first and second removable weight is disposed towards a rear portion of the club head and away from a striking face of the club head, and (b) a non-metallic vibration damping composition disposed between each of the two or more removable weights and a surface of the club head.

2. The club head of claim 1, wherein the two or more removable weights are selected from a group of removable weights that comprises weights of different specific gravity.

3. The club head of claim 2, wherein at least one of the two or more removable weights are secured to the club head with a threaded screw.

4. The club head of claim 2, wherein a layer of the vibration damping composition is disposed between each of the two or more removable weights and a surface of the cavity, wherein the surface of the club head comprises the surface of the cavity.

5. The club head of claim 2, wherein at least a portion of the two or more removable weights comprises a tungsten powder.

6. The club head of claim 2, wherein at least one of the two or more removable weights are secured to the club head through a magnetic force.

7. The club head of claim 2, wherein the vibration damping composition comprises at least one of urethane, rubber, foam, plastics or elastomers.

8. The club head of claim 1, which further comprises a third one of the two or more removable weights disposed in a center portion of the club head.

9. A golf putter comprising:

(a) a golf putter head;

(b) a shaft coupled to the golf putter head, wherein the golf putter head comprises two or more removable weights located within a sole portion of the golf putter head, wherein each weight exhibits approximately the same volume and is disposed in a separate cavity located within the sole portion, wherein: (i) each cavity is configured to receive no more than a single removable weight; (ii) a first removable weight is disposed in a heel portion of the putter head, and a second removable weight is disposed in a toe portion of the putter head; and (iii) the first removable weight and the second removable weight each exhibit a triangular shape having a first side portion and a second side portion forming an angle of approximately 90-degrees, wherein the first side portion of the first and second removable weight is disposed proximate to a side portion of the putter head and the second side portion of the first and second removable weight is disposed towards a rear portion of the putter head and away from a striking face of the putter head; and (c) a non-metallic vibration damping composition disposed between at least one of the two or more removable weights and a surface of the golf putter head.

10. The golf putter of claim 9, wherein the two or more removable weights are selected from a group of removable weights that comprises weights of different specific gravity.

11. The golf putter of claim 10, wherein at least one of the two or more removable weights are secured to the golf putter head with a threaded screw.

12. The golf putter of claim 10, wherein at least one of the two or more removable weights are secured to the golf putter head through a magnetic force.

13. The golf putter of claim 10, wherein the vibration damping composition comprises at least one of urethane, rubber, foam, plastics or elastomers.

14. The golf putter of claim 10, wherein a layer of the vibration damping composition is disposed between each of the two or more removable weights and a surface of the cavity, wherein the surface of the golf putter head comprises the surface of the cavity.

15. The golf putter of claim 10, wherein at least a portion of the two or more removable weights comprises a tungsten powder.

16. The golf putter of claim 9, which further comprises a third one of the two or more removable weights disposed in a center portion of the golf putter head.

17. A method for manufacturing a golf putter head, which comprises:

(a) forming a golf putter head, wherein the golf putter head comprises a sole portion that comprises two or more cavities, wherein each cavity is adapted to receive no more than a single removable weight, wherein (i) each weight exhibits approximately the same volume, (ii) a first removable weight is configured to be disposed in a cavity located in a heel portion of the putter head, and a second removable weight is configured to be disposed in a toe portion of the putter head, and (iii) the first removable weight and the second removable weight each exhibit a triangular shape having a first side portion and a second side portion forming an angle of approximately 90-degrees, wherein the first side portion of the first and second removable weight is disposed proximate to a side portion of the putter head and the second side portion of the first and second removable weight is disposed towards a rear portion of the putter head and away from a striking face of the putter head; and (b) disposing the first and second removable weights in the two or more cavities of the sole portion, wherein a non-metallic vibration damping composition is disposed between the first and second removable weights and a surface of the golf putter head.

18. The method of claim 17, which further comprises selecting the two or more removable weights from a set of removable weights.

19. The method of claim 18, wherein the set of removable weights comprises removable weights that exhibit a plurality of different specific gravities.

* * * * *